US005662042A

United States Patent [19]

Compton et al.

[11] Patent Number: 5,662,042

[45] Date of Patent: Sep. 2, 1997

[54] METHOD OF OPERATING INK UNIT FOR PRINTING PRESS

[75] Inventors: Craig T. Compton, Green Bay; Dale E. Zeman, Denmark, both of Wis.

[73] Assignee: Paper Converting Machine Co., Green Bay, Wis.

[21] Appl. No.: 662,423

[22] Filed: Jun. 10, 1996

[51] Int. Cl.[6] ..... B41F 31/00; B41F 1/46

[52] U.S. Cl. ..... 101/483; 101/350.6; 101/363; 101/366

[58] Field of Search ..... 101/366, 363, 101/207, 208, 209, 210, 350, 483

[56] References Cited

U.S. PATENT DOCUMENTS

| | | | |
|---|---|---|---|
| 4,590,855 | 5/1986 | Schommer et al. | 101/350 |
| 4,821,672 | 4/1989 | Bruno | 101/169 |
| 5,027,513 | 7/1991 | Allison, Jr. | 101/169 |
| 5,125,341 | 6/1992 | Yaeso | 101/367 |
| 5,150,651 | 9/1992 | Flores | 101/366 |
| 5,182,992 | 2/1993 | Rogge | 101/366 |

FOREIGN PATENT DOCUMENTS

0401250B1 12/1990 European Pat. Off. .

OTHER PUBLICATIONS

EFM Jun. 1994.

*Primary Examiner*—Edgar S. Burr
*Assistant Examiner*—Leslie Grohusky
*Attorney, Agent, or Firm*—Tilton, Fallon, Lungmus & Chestnut

[57] ABSTRACT

An ink fountain unit for a printing press having a rotatable cylindrical transfer roll, an ink fountain adjacent the roll and parallel thereto, the fountain being equipped with doctor and containment blades and end seals between the blades, all of the blades and end seals having edges bearing against the roll to define a closed chamber for ink, each of the end seals having relatively elongated, spaced apart first and second angled bearing surfaces confronting the doctor and containment blades and an arcuate bearing surface confronting the roll between the angled surfaces and a recess in a chamber wall of each end seal generally aligned with the arcuate bearing surface top provide a cantilevered edge on the arcuate surface so as to apply in operation less lineal pressure to the roll than to the blades.

10 Claims, 1 Drawing Sheet

METHOD OF OPERATING INK UNIT FOR PRINTING PRESS

BACKGROUND AND SUMMARY OF INVENTION

This invention relates to an ink unit for printing press and method and more particularly, to the novel operation and structure of end seals on the ink fountain associated with a cylindrical transfer roll, i.e., an anilox roll.

The type of apparatus to which the invention is directed is seen in co-owned U.S. Pat. No. 5,125,341. A competitive type of unit is seen in European Patent 0 401 250 B1. The current industry standard for sealing the ends of a doctor blade-equipped closed chamber against an anilox or inking roll is to use a polyolefin foam material. Though this material initially seals very well, over a short period of time ink will eventually leak past the seal and dry on the ends of the anilox roll. This dried or semi-dried ink will rapidly destroy the foam seal or because of lack of doctor blade support over the seal, ink can build up under the doctor blade forcing the seal away from the blade which results in severe leaking and "slinging" of ink onto the press via the anilox roll. This problem has a serious economic impact to a printer due to loss of ink, finished product being ruined and the additional time to clean up the press between job changeovers.

The general environment to which the invention pertains is a fluid fountain unit including a transfer roll and a chamber defined by a holder bearing against the transfer roll. The holder supports doctor and containment blades and end seals all bearing against the transfer roll.

The invention includes applying a first lineal pressure by the end seals against the transfer roll and a second and higher lineal pressure against the doctor and containment blades.

We have found advantageous lineal pressures of the order of about 0.1 pounds per lineal inch (0.0175 Newtons per lineal millimeter) to about 2 pounds per lineal inch (0.35 Newtons per lineal millimeter) for the pressure against the transfer roll and pressures of the order of about 1 pound per lineal inch (0.175 Newtons per lineal millimeter) to about 25 pounds per lineal inch (4.4 Newtons per lineal millimeter) against the blades at a roll seal edge deflection of about 0.010 inches (0.25 mm).

In the illustrated embodiment, this lineal pressure ratio is advantageously developed by equipping each end seal on the inner face or wall thereof (which confronts the chamber) with a recess or hollow section generally aligned with the transfer roll as contrasted to the more solid sections under the blades. This results in local seal stiffness greater at the blade bearing surface than at the roll bearing surface. This provides rigid support for the doctor blade to allow good doctoring but to press lightly against the anilox roll for good sealing and seal life. The seal is able to both seal very well initially and also be more wear-resistant to the dried ink on the ends of the anilox roll than a typical foam seal. In tests, the inventive seal lasts about 15 times longer than the foam seal. Equally important, when the inventive seal is worn out, it leaks gradually as against the severe leaking of a foam seal, i.e., there is no catastrophic ink blowout. The value to a printer is minimal ink loss and slinging and less time to clean up between job changeovers.

Other objects and advantages of the invention may be seen in the details of the ensuing specification.

BRIEF DESCRIPTION OF DRAWING

The invention is described in conjunction with an illustrative embodiment in the accompanying drawing, in which.

DETAILED DESCRIPTION

Figure 1:
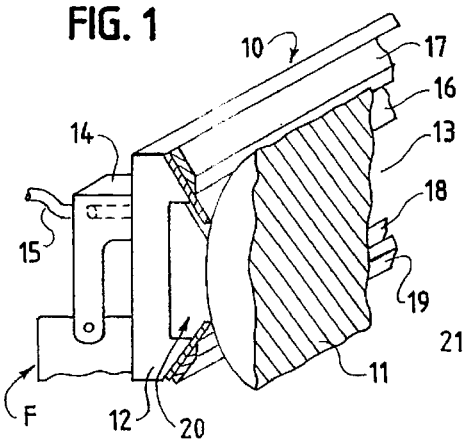
FIG. 1 is a fragmentary perspective view, partly in cross section to show the inventive fountain unit associated with a cylindrical transfer roll.

Referring first to FIG. 1, the symbol F designates generally a frame of a press or the like which pivotally supports the fountain unit 10 of the invention. The unit 10 is shown positioned adjacent to a transfer or anilox roll 11 which is rotatably supported on the frame. The unit 10 includes a subframe which sometimes is referred to as a holder (for the doctor blade, etc.). In any event, the subframe 12 provides an ink chamber 13. Also provided on the frame F are a pair of arms 14 employed to pivot the frame into position against the anilox roll 11. The arms 14 are advantageously equipped with ink delivery means as at 15 which operates to maintain an ink level in the chamber 13. For further details of the mounting and supply, reference may be had to the above mentioned co-owned U.S. Pat. No. 5,125,341 and the prior art cited therein.

Figure 3:
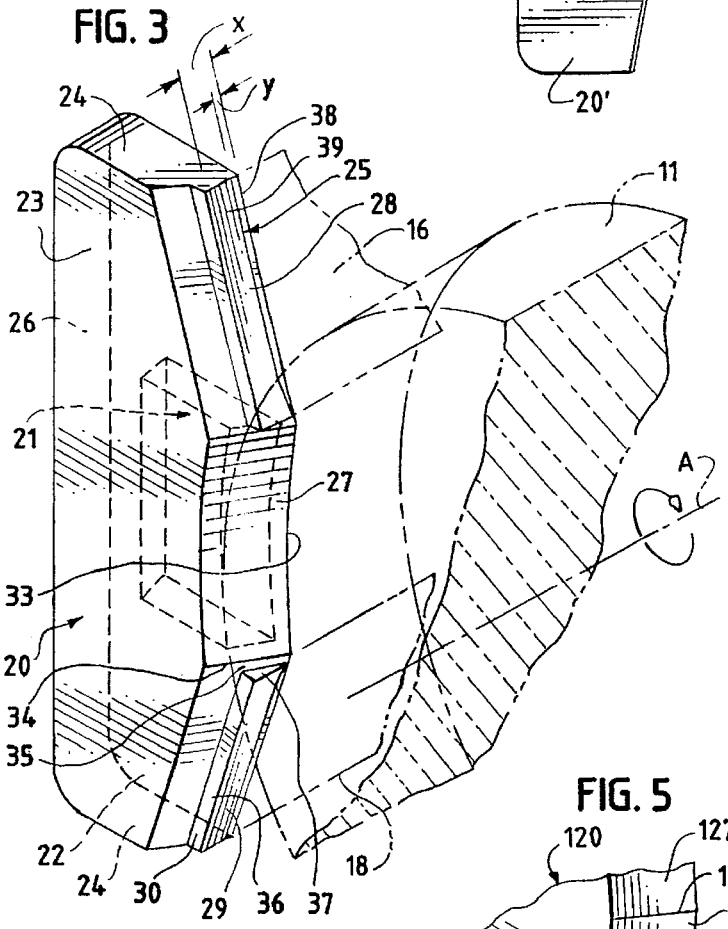
FIG. 3 is an enlarged perspective view of the left hand end seal of the showing in FIG. 1 and also features the doctor and containment blades and a portion of the anilox roll in broken line.

Still referring to FIG. 1, the numeral 16 designates the doctor blade which is seen to be of the reverse angle type. This can be appreciated from the rotation of the anilox roll 11 as depicted in FIG. 3 where the directional arrow is seen to extend clockwise about the axis A of the cylinder 11. Releasably clamping the doctor blade 16 to the subframe or holder 12 is a clamp 17. Omitted for clarity of presentation are securing bolts, etc. for the clamps. Also provided on the frame 12 is the containment blade 18 which is releasably maintained in place by another clamp 19.

Figure 2:
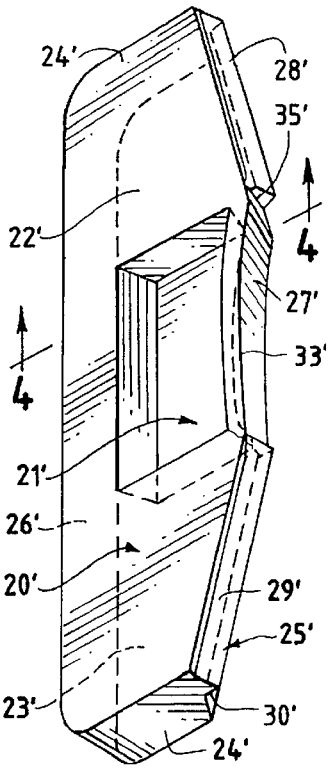
FIG. 2 is an enlarged perspective view of an inventive end seal as it would be seen in the right hand portion of FIG. 1.

The numeral 20 generally designates one end seal in FIGS. 1 and 3, i.e., the left hand end seal, while the right hand end seal (not shown in FIGS. 1 and 3) can be seen in FIG. 2 and is designated by the numeral 20'. It will be appreciated that the end seals 20, 20' are identical and thus inverted or reversed, as shown. The reversal can be appreciated from the fact that there is a recess generally designated 21 shown in a dotted line in FIG. 3 while this is shown in a solid line in FIGS. 2 and 6—as at 21'. To illustrate the similarity yet different orientation, we use the same numerals in FIG. 2 for the same elements in FIG. 3 but with the addition of a (').

Figure 6:
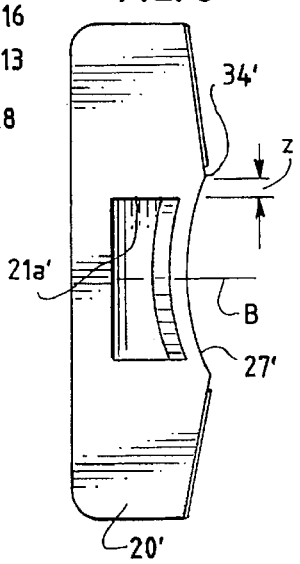
FIG. 6 is a reduced scale side elevational view of the end seal.

This identity facilitates their use in the press structure irrespective of the rotation of the anilox roll. If, for example, the rotation is reversed from that shown in FIG. 3, then the functions of the doctor and containment blades is reversed. For example, the end seal 20' as seen in FIG. 6 is symmetrical about the midplane B.

End Seal Construction

Each end seal 20, 20' includes a unitary body having the configuration generally of a rectangular solid and thereby having a pair of opposed side walls 22, 23, or 22' 23'. The inner wall designated generally 22, 22' is the one facing the chamber 13 and is equipped with the recess 21, 21'. Thus, the side wall 23 is "outboard" and is best seen in FIG. 3. Completing the generally rectangular solid are end walls 24, 24', front walls generally designated 25, 25' and rear walls 26, 26'.

The front walls 25, 25' have three sections—the first being at 27, 27' in the center which provides the bearing against the transfer roll 11 and is thus arcuate, i.e., being a portion or segment of a cylinder. Flanking this are the blade bearing surfaces 28, 28' and 29, 29' which are angled at the blade inclination.

Figure 5:
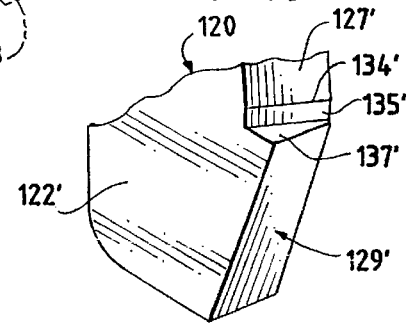
FIG. 5 is a fragmentary perspective view similar to the lower portion of FIG. 3 but showing a modified form of end seal.

In the embodiment of FIGS. 2 and 3, the front wall 25, 25' does not extend completely between side walls 22, 22' and 23, 23' but terminates short of the outer side wall 23, 23' so as to develop a step 30, 30'—see the lower portions of FIGS. 2 and 3. However, the invention may be practiced to equal advantage with the angled front surfaces extending uninterruptedly from one side wall to the other—as at 129' in FIG. 5 of the seal 120'. This extends all the way from one side wall 122' to other (not numbered but corresponding to the wall 23').

Figure 4:
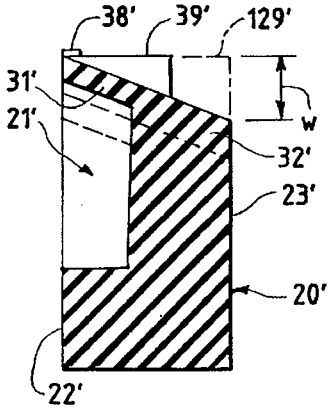
FIG. 4 is a sectional view of the seal body seen in FIG. 2 along the sight line 4—4.

The arcuate, tapered bearing surface 27, 27' confronting the roll 11 is made up of two parts—a first cantilevered part 31' which is over the recess 21' and a more solidly supported part 32' outboard of the recess 21'—see FIG. 4. The part 31' of the surface 27' is the most flexible portion of the seal and allows the operator to adjust the blade pressure against the anilox roll 11 without losing the seal. Also, it is constructed and arranged to minimize seal wear. As indicated above, the cantilevered aspect is developed by providing the recess generally designated 21, 21'—best seen in the central portion of FIG. 2. This recess has generally the shape of the exterior of a solid tetragon, i.e., a four-sided figure having a discrete third dimension. This third dimension may extend about one third to about two thirds of the thickness of the end seal 20'—see FIG. 4 and compare the thicknesses of the parts 31' and 32'.

The thickness of the cantilevered part 31' (see FIG. 4) is of the order of 0.06" (1.6 mm) to about 0.250" (6.4 mm) when an anilox roll of normal dimensions, viz., about 6" (150 mm) in diameter, is employed. Advantageously, the dimension of the recess 21' in the direction parallel to the side wall 22' is slightly less than that of the arcuate surface 27'. The surface 27' is advantageously a segment or portion of a cylinder so that as the inner edge 33' wears (see FIGS. 2 and 4), the resulting edge still conforms to the shape of the anilox roll. Further, the dimension of the recess 21' in the transverse direction, viz., in the direction between the front and rear walls 25, 26, is of the order of about 0.250" (6.4 mm) to about 1.5" (38 mm). All of the size, shape and number of recesses can vary greatly in order to accomplish the desired seal characteristics.

The seal material is a thermoplastic/thermoset combination rubber which is marketed under the tradename SANTOPRENE supplied by Advanced Elastomer Systems located in Akron, Ohio. In the thermoplastic family, the property of this material falls between the properties of olefinics and urethanes. In the thermoset rubber family, its properties fall between polychloroprenes and chlorosulfonated polyethylenes. For example, the Durometer is of the order of about 70 on Shore A, the specific gravity is 0.98, the tensile strength is 1200 psi (8.3 MPa), the ultimate elongation is 410% and the 100% modulus is 470 psi (3.2 Mpa). The inventive seal 20 is directly interchangeable with the existing polyolefin foam end seals. And, as indicated above, the operator has a choice of utilizing either inventive seal at the end of the same doctor blade holder. And, replacement or retrofitting of existing foam seals can be effected by providing an end seal of the dimension as the previous end seals.

Another advantageous feature of the invention is the arrangement of the angled surface 28, 29 as illustrated by the surface 29 in the lower central portion of FIG. 3 relative to the adjacent transverse edge 34 of the arcuate surface 27. There is a discrete spacing 35 of the order of about 1/16" (1–2 mm)—in the case of a 6" diameter anilox roll—which is advantageous in permitting the associated blade 16 or 18 to come down right to the inner corner of the arcuate surface, i.e., in the illustration just described, the intersection of the edge 34 and the free edge 33. Should the integral wedge shaped formation 36 providing the bearing surface 29 extend up to the edge 34 (rather than terminate as at the wall 37), there is the possibility that the associated blade 18 might not form a perfect seal at the corner developed by the intersection of the edges 33 and 34. So, we offset slightly the adjacent end of the integral projection 36 from the adjacent edge of the arcuate surface 27. This also applies to the embodiment of FIG. 5 where the arcuate surface 127' terminates at 134'—short of the axially-extending wall 137' at the end of the bearing surface 129'—resulting in a generally planar surface or spacing 135'—see also 35' in FIG. 2. This advantage accrues because of the unitary construction of the end seals 20, 20'.

The advantageous feature provided by the recess 31' is also illustrated by the dimension "z"—see FIG. 6. There, it will be seen that the recess wall **21*a* is spaced inwardly of the edge 34' of the arcuate surface 27'. In the illustration for the 6" (150 mm) anilox roll, this dimension z is in the range of about 0.015" (0.4 mm) to about 0.045" (1.2 mm.). This provides a good seal at the roll-blade intersection at 34'** by giving a rigid support at this difficult seal area.

On the other hand, the seal 20 or 20' provides sufficient flexibility (or adjustability) to allow the operator to adjust the doctor blade and containment blade against the anilox roll without losing the sealing needed.

Typically blade deflections are of from about 0.010" (0.25 mm) to about 0.060" (1.5 mm) depending on ink type, roll characteristics and blade thickness. So we find it advantageous to provide the dimension "W" at a minimum of 0.060" (1.5 mm)—see FIG. 4.

Still further, for most advantageous operation, the doctor blade 16 should protrude an amount of dimension "x" past the seal edge 33—see FIG. 3. This may be the total width of the bearing surfaces 28, , 28', 29, 29' or 129' of the order of about 1/3" (10 mm). The containment blade 18 needs to protrude no further than dimension "y" (still referring to FIG. 3) which is less than dimension "x". The dimension "y" may be of the order of about 1/32", viz., of the order of about 1 mm. If the containment blade 18 protrudes further than the doctor blade 16, the doctor blade may not be able to scrape ink off the ends of the anilox roll 11 which could create ink slinging and premature seal wear.

An additional advantageous feature of the first illustrated embodiment is the transverse contour of the angled bearing surfaces 28, 28', 29 29'. These have a slightly elevated, longitudinally-extending zone 38' (see FIG. 4) and a somewhat lower zone 39'. The zone 38' is immediately adjacent the inner edge 33' (the continuation of the free edge of the arcuate bearing portion 27) while the zone 39' is remote or spaced from the edge 33'. Corresponding zones 38, 39 (see FIG. 3) are likewise provided in the angled surfaces 28, 29 of the end seal 20.

The showing in FIG. 4 of the end seal 20' is exaggerated—the height of zone 38' over that of zone 39' (for a 6" diameter anilox roll) is of the order of about 0.02" (0.5 mm) to about 0.050" (1.25 mm). Especially advantageous results are obtained with a projection of the zone 38 above the zone 39 is of the order of about 0.030" (0.75 mm). In the illustration given, the width of the total surface designated 28 is equal to the dimension "y" in FIG. 3. The zone 38 has a width "z" and the width of zone 28 is therefore "x–y".

More generally, the width of the first zonal surface 38 is about 10% to about 30% of the entire width of the combined zonal surface 38, 39, i.e., the width dimension of the surfaces 28, 28', 29, 29' and/or 129'. Thus, the first zonal surface 38 is narrower than the second zonal surface 39.

In operation, the seal perimeter or edge surfaces seal under the doctor and containment blades 16, 18 respectively. Since the zonal surfaces 38, 38' protrude or peak slightly above the blade support zonal surfaces 28, 28', 29, 29', 129', when the doctor and containment blades 16 and 18 are pressed against the zonal surfaces 39, 39', the material deforms and provides a seal under these two blades.

As indicated, the wider adjacent zonal surfaces 39, 39' are the principal supporting surfaces for the two blades while the zonal surfaces 38, 38' are the principal sealing surfaces. This wider part of the end seal is solid in construction and the most rigid portion of the seal. As discussed relative to FIG. 5, the zonal surface 39' (see FIG. 4) need not terminate short of the side wall 122' but may extend to it, also as illustrated at 129' in FIG. 4.

For example, the zonal surface 38 or 38' provides rigid support for the doctor blade 16 which can then scrape any ink off anilox roll 11 that leaks past the seal. This prevents ink from building up on the anilox roll 11 and prematurely wearing out the seal 20.

In summary the invention provides an ink fountain unit for a printing press having a relatively elongated cylindrical transfer roll 11, mounted for rotation about the cylinder axis A, a relatively elongated ink fountain 10 mounted adjacent the roll and parallel thereto, the fountain being equipped with generally planar doctor and containment blades 16, 18 and end seals 20, 20' between the blades, all of the blades and end seals having free edges bearing against the roll to define a closed chamber for ink, each of the end seals having relatively elongated, spaced apart first and second angled bearing surfaces 28, 28', 29, 29' confronting the doctor and containment blades and an arcuate bearing surface 27, 27' confronting the roll between the angled surfaces. Recess means are provided as at 21, 21' in each end seal to develop an arcuate, inclined and cantilevered section 31' (see FIG. 4). This provides a lower lineal pressure against the transfer roll 11 than against the blades 16, 18.

While in the foregoing specification a detailed description of an embodiment of the invention has been set down for the purpose of illustration, many variations in the details hereingiven may be made by those skilled in the art without departing from the spirit and scope of the invention.

We claim:

1. A method of operating a printing press comprising the steps of providing a fluid fountain unit including a transfer roll and a chamber defined by a holder adjacent said transfer roll, said chamber including doctor and containment blades and unitary end seals all bearing against said transfer roll, applying a first lineal pressure by the end seals against said transfer roll and applying a second and higher lineal pressure against said doctor and containment blades.

2. The method of claim 1 in which said first lineal pressure is in the range of about 0.1 pounds per lineal inch (0.0175 Newtons per lineal millimeter) to about 2 pounds per lineal inch (0.35 Newtons per lineal millimeter) and second lineal pressure is in the range of about 1 pounds per lineal inch (0.175 Newtons per lineal millimeter) to about 25 pounds per lineal inch (4.4 Newtons per lineal millimeter) at a free seal edge deflection of about 0.010 inches (0.25 mm).

3. The method of claim 1 in which said first and second lineal pressures are developed by equipping each end seal with an empty recess in a wall thereof confronting said chamber, said recess being relatively elongated in the circumferential direction of said transfer roll, and aligning the length of said recesses generally with said transfer roll.

4. The method of claim 3 in which providing step includes also providing each end seal with a bearing surface confronting said blades and said transfer roll, said bearing surface having an arcuate portion confronting said transfer roll and angled generally planar portions confronting said blades, and restricting the recess length to less than the length of said arcuate bearing surface.

5. The method of claim 4 in which said restricting step includes overlapping said arcuate bearing surface relative to each end of said recess and with the overlap being in the range of about 0.015 inches (0.4 mm) to about 0.045 inches (1.2 mm).

6. The method of claim 1 in which said providing step includes constructing each end seal of a thermoplastic/thermoset rubber having a Shore A durometer of about 70.

7. The method of claim 1 in which said providing step includes also providing each end seal with a bearing surface confronting said blades and said transfer roll, said bearing surface having an arcuate portion confronting said transfer roll and angled generally planar portions confronting said blades, and terminating said angled generally planar portions slightly short of said arcuate bearing surface.

8. The method of claim 7 in which said providing step also includes flanking each end of said arcuate bearing surface with a generally planar surface and intersecting each generally planar surface with a terminal wall of said angular bearing surfaces.

9. The method of claim 1 in which said providing step also includes providing each end seal with a bearing surface confronting said blade and said transfer roll, said bearing surface having an arcuate portion confronting said transfer roll and angled generally planar portions confronting said blades, said angled generally planar portions having an edge adjacent said chamber and providing each of said angled generally planar portions with a first longitudinally extending zone adjacent said edge and a second longitudinally extending zone remote from said edge, and extending said first zone above said second zone.

10. The method of claim 9 in which said providing step includes providing said first zone narrower than said second zone.

* * * * *